US008231337B2

(12) United States Patent
Andersson

(10) Patent No.: US 8,231,337 B2
(45) Date of Patent: Jul. 31, 2012

(54) PUMP FOR PUMPING LIQUIDS INCLUDING SOLID MATTER

(75) Inventor: Patrik Andersson, Skogås (SE)

(73) Assignee: Xylem IP Holdings LLC, White Plains, NY (US)

( * ) Notice: Subject to any disclaimer, the term of this patent is extended or adjusted under 35 U.S.C. 154(b) by 1044 days.

(21) Appl. No.: 11/994,358

(22) PCT Filed: Jun. 5, 2006

(86) PCT No.: PCT/SE2006/000662

§ 371 (c)(1),
(2), (4) Date: Jul. 21, 2008

(87) PCT Pub. No.: WO2007/004943

PCT Pub. Date: Jan. 11, 2007

(65) Prior Publication Data

US 2009/0123270 A1 May 14, 2009

(30) Foreign Application Priority Data

Jul. 1, 2005 (SE) ..... 0501542-5

(51) Int. Cl.
*F04D 29/18* (2006.01)

(52) U.S. Cl. ..... 415/131; 415/121.1; 415/216.1; 416/244 R

(58) Field of Classification Search ..... 415/140, 415/97, 34, 131, 132, 121.1
See application file for complete search history.

(56) References Cited

U.S. PATENT DOCUMENTS

| | | | | |
|---|---|---|---|---|
| 2,865,299 A | | 12/1958 | Hernschuch et al. | |
| 4,417,849 A | * | 11/1983 | Morris | 415/131 |
| 5,722,812 A | * | 3/1998 | Knox et al. | 415/199.1 |
| 6,190,121 B1 | * | 2/2001 | Hayward et al. | 415/121.1 |
| 6,464,454 B1 | | 10/2002 | Kotkaniemi | |
| 2001/0031202 A1 | * | 10/2001 | Nowack | 415/206 |

FOREIGN PATENT DOCUMENTS

| | | |
|---|---|---|
| EP | 0924434 A1 | 6/1999 |
| EP | 1247990 A1 | 10/2002 |
| EP | 1357294 A2 | 10/2003 |
| JP | 54-89301 | 7/1979 |
| JP | 1-200091 | 8/1989 |
| JP | 5-37198 | 2/1993 |
| JP | 09-4585 | 1/1997 |
| JP | 2008-519218 | 11/2008 |
| WO | 2005/038260 | 4/2005 |
| WO | 2007/004943 | 1/2007 |

OTHER PUBLICATIONS

English translation of Official Action issued in Japanese patent application No. 2008-519218, 2 pages (May 11, 2011).

International Preliminary Report on Patentability and Written Opinion of the International Searching Authority issued in PCT/SE2006/000662, 6 pages (Jan. 9, 2008).

* cited by examiner

*Primary Examiner* — Victor A Mandala
*Assistant Examiner* — Krista Soderholm
(74) *Attorney, Agent, or Firm* — Browdy and Neimark, PLLC

(57) ABSTRACT

The invention relates to a pump for pumping contaminated liquid including solid matter, comprising a pump housing provided with a rotatable impeller suspended in a drive shaft and having at least one vane, and an impeller seat, at least one part of the impeller and the impeller seat being movable in the axial direction in relation to each other. Furthermore, the impeller seat presents at least one groove in the top surface thereof.

15 Claims, 5 Drawing Sheets

PUMP FOR PUMPING LIQUIDS INCLUDING SOLID MATTER

TECHNICAL FIELD OF THE INVENTION

The present invention relates generally to the field of pumps for, sewage or waste water, and more specifically to a pump for pumping unscreened contaminated liquid including solid matter, such as plastic materials, hygiene articles, textile, rags, etc. Said pump comprises a pump housing provided with a rotatable impeller suspended in a drive shaft and having at least one vane, and an impeller seat, at least one part of the impeller and the impeller seat being movable in the axial direction in relation to each other.

BACKGROUND OF THE INVENTION

In sewage stations, septic tanks, wells, etc., it often occur that solid matter or pollutants, such as socks, sanitary pads, paper, etc., clogs the submersible pump that is lowered into the basin of the system. The contaminations are sometimes too big to pass through the pump if the impeller and the impeller seat are located at a fixed distance from each other.

In order to get rid of the clogging matter, it is known to equip centrifugal pumps with means for cutting up the solid matter into smaller pieces and thereafter evacuate the small pieces together with the pumped liquid. However, the cutting up of the solid matter is energy intensive, which is adverse especially since pumps of this kind usually operates for long periods of time. Another conventional way of getting rid of clogging matter is to use an impeller having only one vane, which present one large throughput channel capable of letting through the solid matter. One drawback with this type of pump is that the solid matter often get tangled around the leading edge of the vane. A third attempt, to solved the problem of large solid matter clogging the pump, use a arrangement in which the impeller is at a fixed distance from the impeller seat, e.g. 30-40 mm. A huge drawback is that the pump has a really low efficiency all the time.

A better way of solving the problem of solid matter clogging the pump should be to admit the impeller and the impeller seat to be movable in the axial direction in relation to each other, in order to form a gap. But known pumps comprising this feature uses said gap for other purposes. Furthermore, they only admit a small gap between the impeller and the impeller seat. In EP 1,247,990 is shown a pump, the impeller of which is movable in the axial direction in relation to the impeller seat along the longitudinal direction of the drive shaft. But the movability is strongly limited and the object solved is only to admit operational start in a dry state, e.g. now liquid in the pump. GB 751,908 shows a pump having a manually controlled movability of the impeller in relation to the impeller seat. The object of this construction is to admit a regulation of the efficiency of the pump. U.S. Pat. No. 6,551,058 shows a pump having an impeller which is movable in the axial direction in relation to the drive shaft. The object of the shown construction is to avoid the vanes of the impeller to be damaged if solid matter enters the pump.

More precisely, none of the abovementioned, or other, documents present a solution, or an object, usable for letting through large pieces of solid matter. Even though small pieces of solid matter might pass through the gap that is formed between the lower edge of the impeller and the impeller seat, it is more likely that large pieces of solid matter will get stuck in the narrow gap formed. In a worst case scenario, the impeller might get totally jammed and thus seriously damage the pump. Such an unintentional shutdown is costly, due to expensive, cumbersome and unplanned maintenance work. It is even better if the sol d matter blocks the inlet of the pump than the solid matter gets jammed between the vane of the impeller and the impeller seat. If the inlet is blocked the only effect is that less fluid will get pumped through the pump, but if the impeller is jammed he pump might get damaged.

A closely related patent, EP 1,357,294 directed to the applicant, shows a pump which is exposed for solid matter included in unscreened sewage water. The pump has a groove in the top surface of the impeller seat for transportation of the entire contaminating subject towards the periphery of the pump housing. However, it is strictly described that the impeller shall not be movable in relation to the impeller seat, due to the object of scraping of solid matter from the vane against the edge of the groove.

Furthermore, submergible pumps are used to pump fluid from basins that are hard to get access to for maintenance and the pumps often operate for long periods of time, not infrequently up to 12 hours a day or more. Therefore it is highly desirable to provide a pump having long durability.

SUMMARY OF THE INVENTION

The present invention aims at obviating the aforementioned disadvantages of previously known pumps, and at providing an improved pump. A primary object of the present invention is to provide an improved pump of the initially defined type, which in a reliable way admits large sol d matter to pass through the pump, without having to cut up the solid matter into smaller pieces. It is another object of the present invention to provide a pump with respect to the reduce friction between the impeller and the drive shaft in the axial direction, in order to get a better movability or the impeller. It is yet another object of the present invention to provide a pump having an improved durability, thanks to a reduced friction in the interface between the impeller and the drive shaft, and by that a more reliable control of the impeller during movement.

According to the invention at least the primary object is attained by means of the initially defined pump having the features defined in the independent claim. Preferred embodiments of the present invention are further defined in the dependent claims.

According to the present invention, there is provided a pump of the initially defined type, which is characterized in that the impeller seat presents at least one groove in the top surface thereof.

Thus, the present invention is based on the insight of the importance that a movability of the impeller in the axial direction a distance too short in relation to the size of the solid matter brings about other and even worse problems than preventing the fluid to be pumped. More precisely, it is important to undoubtedly remove solid matter from the gap between the vane of the impeller and the impeller seat.

In a preferred embodiment of the present invention, the groove extends in a spiral shape from a centrally located open channel in the impeller seat to the periphery thereof, along the direction of rotation of the impeller. This means that if the leading edge of the vane of the impeller hit a piece of solid matter, the solid matter will get forced outwards towards the impeller seat as a consequence of the centrifugal force and that the leading edge of the vane is back swept. When the solid matter meets the groove in the top surface of the impeller seat it will follow the shape of the groove outwards and at the same time lift the impeller from the impeller seat, and thus quickly be passed through the pump.

According to a preferred embodiment, the impeller may be moved a great distance from the impeller seat, preferably as much as the diameter of the open channel of the impeller seat. Then the ability to pass solid matter through the pump is considerably increased.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1:
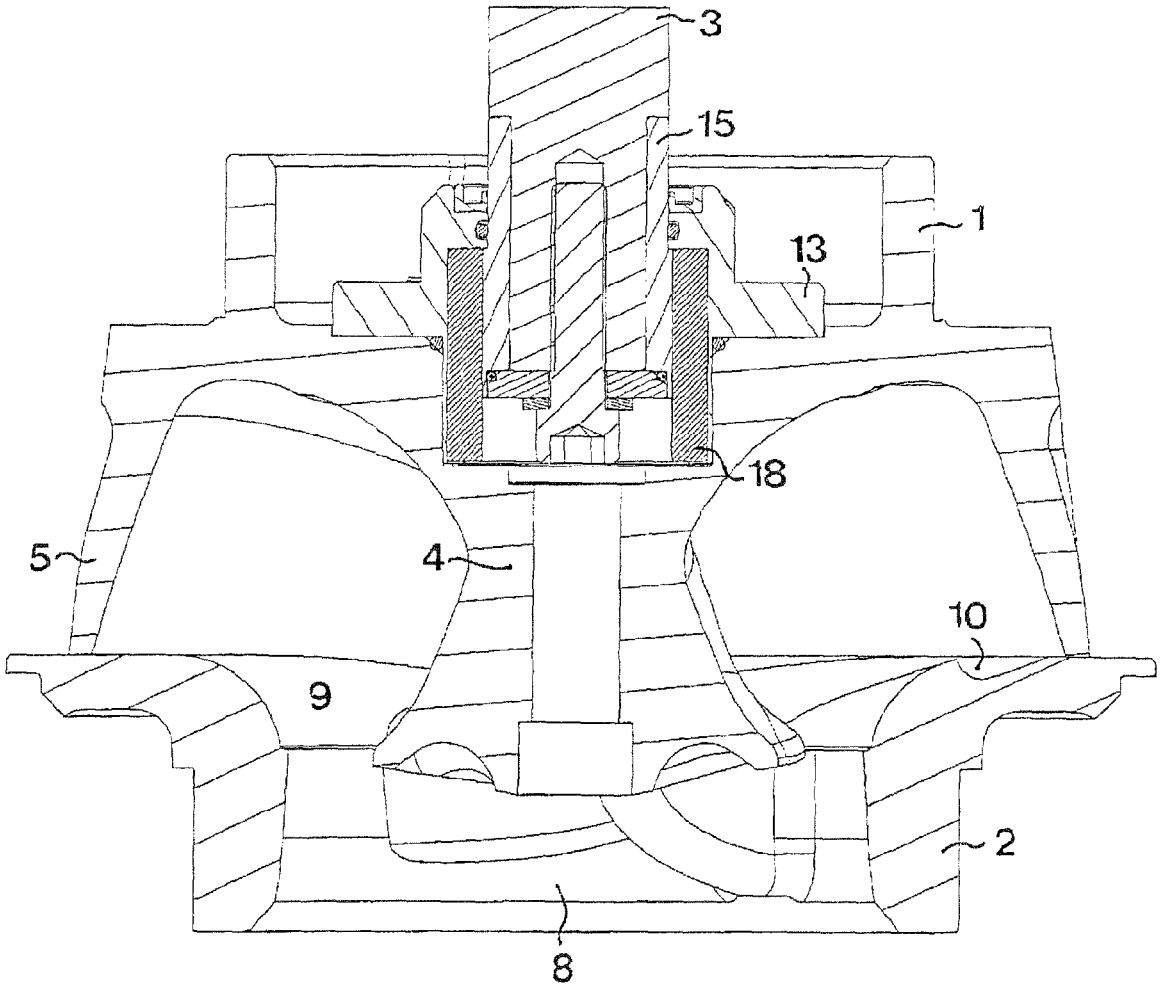
FIG. 1 is a cross sectional view of the impeller and the impeller seat, the impeller being in a first, lower position.
Figure 2:
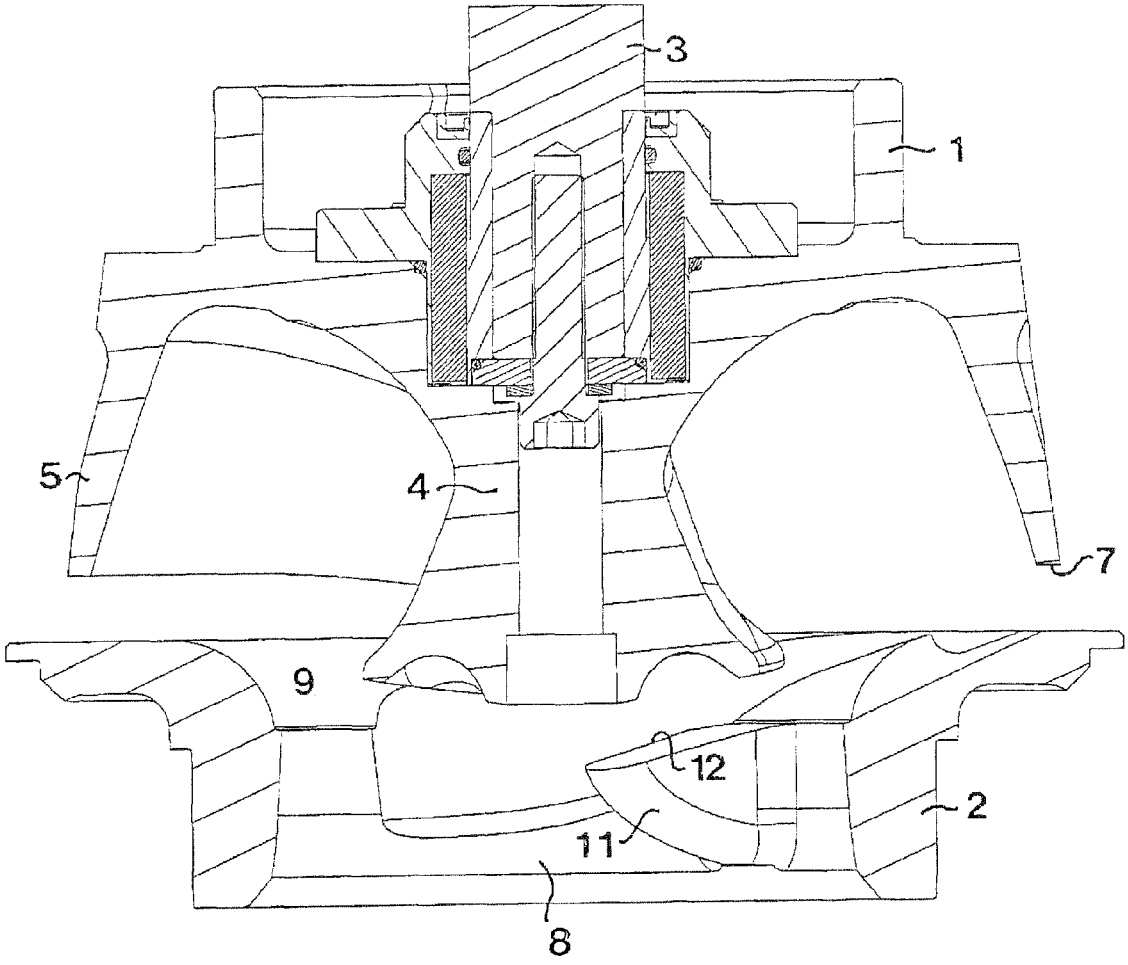
FIG. 2 is a cross sectional view or the impeller and the impeller seat, the impeller being in a second, upper position.

FIGS. 1 and 2 snow an impeller 1 and an impeller seat 2, usually accommodated in a pump housing of a pump (not shown). The other parts of the pump are removed for the sake of simplicity of reading the figures. The invention relates to pumps in general, but in the preferred embodiment the pump is constituted by a submergible centrifugal pump.

In a preferred embodiment of the present invention the impeller seat 2 is constituted by an insert releasably connected to the pump housing by being located in a seat in the pump housing in such a way that the insert cannot rotate relative to the pump housing. The impeller 1 is suspended in a drive shaft 3 extending from above, and is rotatable in the pump housing. The first, upper end (not shown) of the drive shaft 3 is connected to the engine of the pump. The second, lower end of the drive shaft 3 is connected to the impeller 1 by means of a joint in such a way that the impeller 1 is movable in the axial direction along the drive shaft 3, but rotates jointly with the drive shaft 3. Preferably the drive shaft 3 is inserted in a centrally located hub 4 of the impeller 1.

Figure 5:
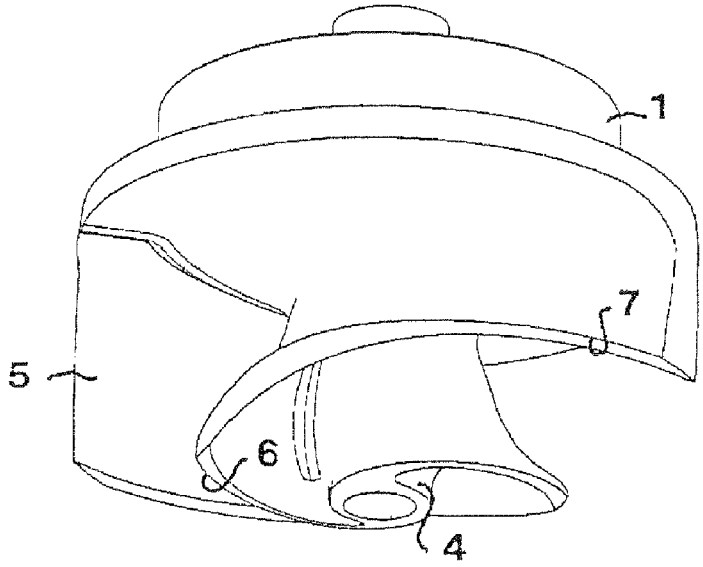
FIG. 5 is a perspective view from below of the impeller.
Figure 6:
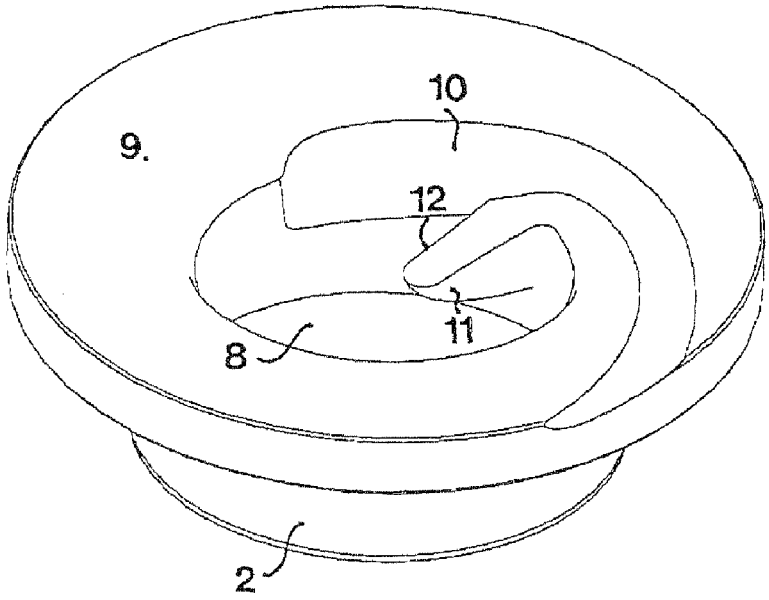
FIG. 6 is a perspective view from above of the impeller seat.

Reference is now also made to FIGS. 5 and 6. The impeller 1 comprises at least one vane 5 extending from the hub 4 towards the periphery of the impeller 1, preferably in a spiral shape.

The direction of rotation of the impeller 1 is clockwise in he shown embodiments, and the vanes 5 are extending in the opposite direction, i.e. counter clockwise. In the shown embodiment the impeller 1 has two vanes 5, each having an extension running approximately 270 degrees around the hub 4, but it shall be pointed out that the number of vanes 5 and the length of the vanes 5 may vary greatly, in order to suit different liquids and applications. For example, each vane may extend in a straight line radially outwards from the hub. Each vane 5 comprises a leading edge 6 and a lower edge or tip surface 7. The leading edge 6 is located directly above a centrally located open channel 8 of the impeller sea 2 and the lower edge 7 of the vane 5 is located above a cop surface 9 of the impeller seat 2.

In the too surface 9 of the impeller seat 2 and contiguous to the open channel 8 of the impeller seat 2, is provided at least one groove or relief groove 10. The groove 10 extends from the open channel 8 of the impeller seat 2 towards the periphery thereof. Preferably in a spiral shape that sweeps outwards in the direction of rotation of the impeller 1, i.e. in an opposite direct on to the one of the vanes 5. The number of grooves 10 and their shape and orientation may vary greatly, in order to suit different liquids and applications. The function of the groove 10 is to guide the solid matter outwards to the periphery of the pump housing. As the solid matter passes through the pump, some will fasten underneath the vanes 5 of the impeller 1 and slow down the rotating motion of the impeller 1 and even stop the same. But the groove 10 contribute to keep the vanes 5 clean, by scraping of the solid matter each time the vane 5 passes the same. If the solid matter is to big to fit in the groove 10, between the impeller 1 and the impeller seat 2, the impeller 1 will be moved upwards away from the impeller seat 2 by the solid matter and thereby admitting the solid matter to pass through the pump.

The shape of the lower edge 7 of the vane 5 corresponds, in the axial direction, to the shape of the top surface 9 of the impeller seat 2. The axial distance between the lower edge 7 and the top surface 9 ought to be less than 1 mm when the impeller 1 is in the first, lower position shown in FIG. 1. Preferably said distance is less than 0.7 mm and most preferably less than 0.5 mm. At the same time said distance shall be more than 0.1 mm and preferably more than 0.3 mm. If the impeller 1 and the impeller seat 2 are to close to each other a frictional force or a breaking force acts on the vanes 5 of the impeller 1.

In order to ensure that the open channel 8 does not get clogged, the impeller seat 2 is preferably provided with, means for guiding the solid matter towards the groove 10. The guiding means comprises at least one guide pin 11 extending from the top surface 9 of the impeller seat 2, more precisely from the part of the top surface 9 facing the open channel 8. The guide pin 11 extends generally in the radial direction of the impeller seat 2 and is located below the impeller 1 and presents an upper edge 12, which extends from a position contiguous to the most inner part of the vane 5 of the impeller 1 to the top surface 8 of the impeller seat 2. More precisely, the most inner part of the upper edge 12 of the guide pin, 11 is located at approximately the same radial distance from the center of the impeller 1 as the most inner part of the vane 5 of the impeller 1. Preferably the upper edge 12 of the guide pin 11 terminates adjacent to the "inlet" of said groove 10. The axial distance between the upper edge 12 of the guide pin 11 and the leading edge 6 of the vane to ought to be less than 1 mm, when the impeller 1 is in the first, lower position. Furthermore, the upper edge 12 of the guide pin 11 corresponds to and is located adjacent to the leading edge 6 of the vane 5 of the impeller 1.

The axial movability between the impeller 1 and the impeller seat 2 should be any appropriate length depending on the application, i.e. from 0 mm and upwards. Preferably said movability should be at least 15 mm, more preferably at least 40 mm, and most preferably at least as much as the diameter of open channel 8. Zn the shown embodiment the diameter of the open channel 8 is 150 mm. Furthermore, the axial movability may be achieved in a lot of ways but in a preferred embodiment of the present invention the impeller 1 is movable along the axial direction of the drive shaft 3.

Figure 3:
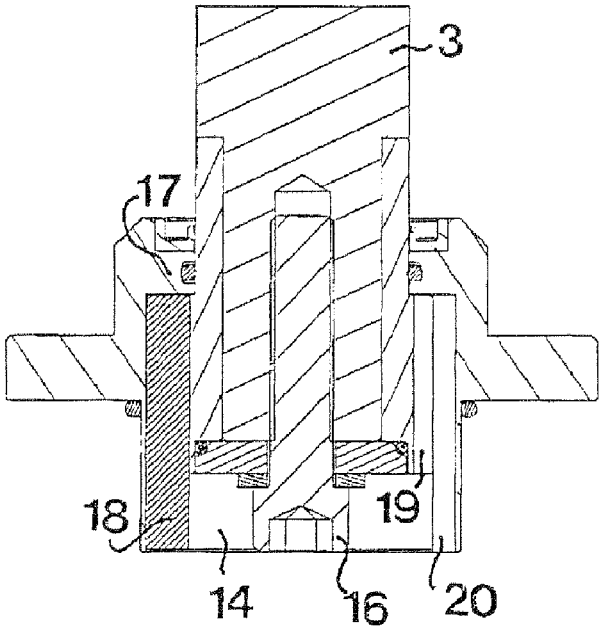
FIG. 3 is an enlarged cross sectional view of one embodiment of the joint between the impeller and the drive shaft, the impeller being removed.
Figure 4:
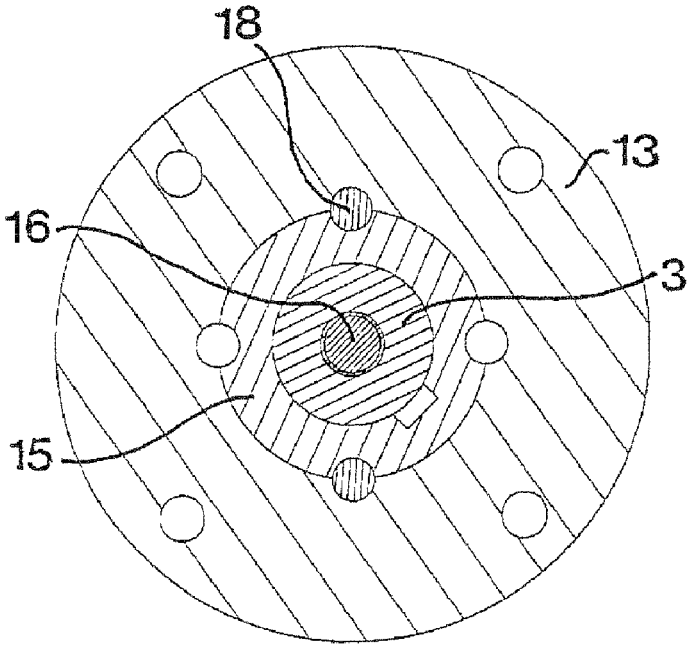
FIG. 4 is a cross sectional view from above of the joint in FIG. 3.

Reference is now made to FIGS. 3 and 4. In FIG. 3 is shown a joint of the pump admitting axial movability of the impeller 1 in relation to the drive shaft 3, at the same time as the drive shaft 3 transmits a turning motion to the impeller 1. The joint comprises a socket 13 provided in the central hub 4 of the impeller 1, and connected to the impeller 1 by means of bolts (not shown), or the like. Alternatively the socket 13 may be integrated with the impeller 1. The socket 13 presents a cavity 14 in a central part thereof, which cavity 14 accommodate the second, lower end of the drive shaft 3. In the preferred embodiment of the present invention the drive shaft 3 is provided with a sleeve 15 at the second, lower end thereof, the sleeve 15 being connected to the drive shaft 3 by means of a bolt 16 and/or key and keyway, or the like. Alternatively the sleeve 15 may be integrated with the drive shaft 3.

The sleeve 15 has a first, upper part having a first external diameter, which is essentially equal to the internal diameter of a flange 17 of the socket 13. Furthermore, the sleeve 15 has a second, lower part having a diameter larger than said first diameter of the sleeve 15. The diameter of the second part of the sleeve 15 is essentially equal to the internal diameter of the cavity 14. Due to these dimensional relationships the impeller 1 is suspended in the drive shaft 3. The cavity 14 presents a larger extension in the axial direction than the second part of the sleeve 15, the socket 13 and the impeller 1 being movable a distance essentially equal to that difference.

In a first embodiment of the invention the joint comprises at least one discrete element 18 arranged at the interface between the socket 13 or impeller 1 and the sleeve 15 or the drive shaft 3. The element 18 imperatively transmits a turning motion from the drive shaft 3 to the impeller 1 and admits the impeller 1 to move along the drive shaft 3. The socket 13 is provided with a recess 19 for each element 18, the recess 19 extending in the axial direction of the drive shaft 3. In the sleeve 15, opposite to the recess 13 of the socket 13, is formed an interacting recess 20, which together with the recess 19 of the socket 13 accommodate said element 18. In FIG. 3 the right element 18 is removed in order to get a general view of the recesses 19, 20. In FIG. 4 the left and right element 18 are removed. Preferably only two elements 18 are used and the dimensions of the elements 18 are determined by the torque being transmitted from the drive shaft 3 to the impeller 1. In the shown embodiment in FIGS. 1-4 the discrete element is constituted by a bar, preferably a circular bar, due to a manufacturing point of view.

It shall be pointed out that in an alternative embodiment the discrete element 18 can be constituted by a number of balls following the recess 19 of the sleeve 15 as the impeller 1 moves in the axial direction. More precisely, the recess 19 of the sleeve 15 has upper and lower obstructions that prevent the balls from escaping into the cavity 14. Alternatively, the discrete element 18 may be integrated with the inner surface of the sleeve 15, i.e. ridges on the inner surface extending into the recesses 19 of the socket 13.

Figure 7:
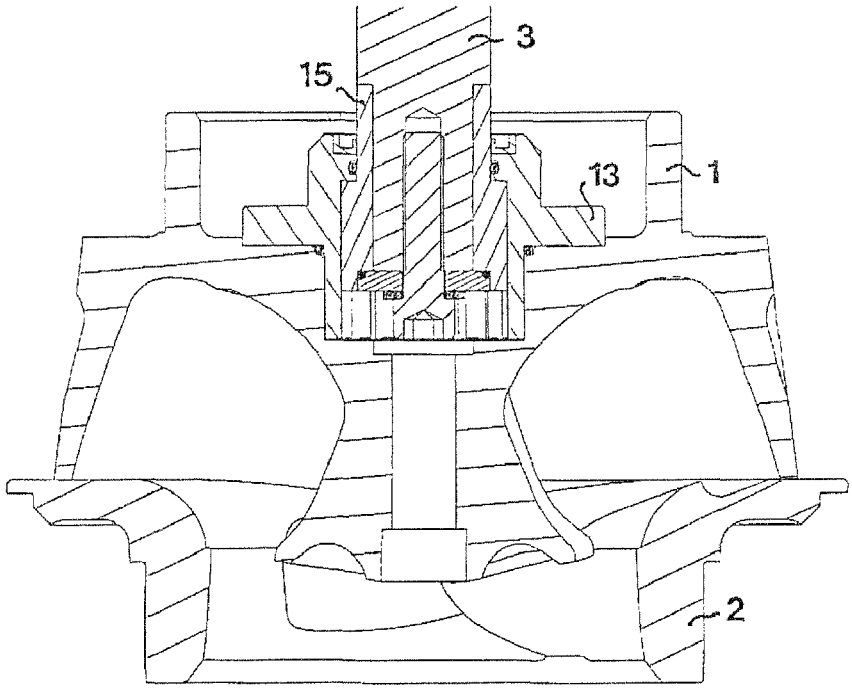
FIG. 7 is a cross sectional view of the impeller and the impeller seat, having an alternative joint.
Figure 8:
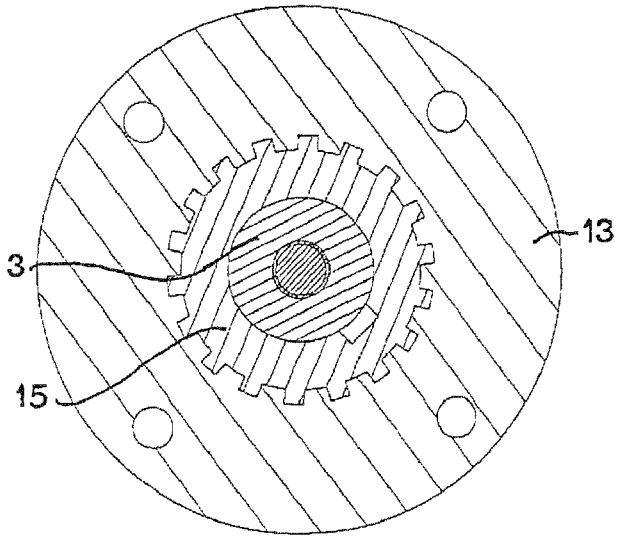
FIG. 8 is a cross sectional view from above of the joint in FIG. 7.

The relative movability of the impeller 1 along the drive shaft 3 may alternatively be realized by means of a spline joint between the impeller 1 and the drive shaft 3, shown in FIGS. 7 and 8. One advantage of using a spine joint is that the joint will comprise fewer elements.

The impeller 1 is, in a preferred embodiment of the present invention, freely movable along the drive shaft 3 since there are no springs or the like obstructing the movement. More precisely, any force from a solid matter on the impeller 1 from underneath that overcomes the high pressure on the too side of the impeller 1 will manage to raise the impeller 1 from the impeller seat 2. When the solid ratter is removed the impeller 1 automatically will return to the lower position according to FIG. 1 since the pressure on the top side of the impeller 1 is higher than the pressure on the bottom side of the impeller 1.

Alternatively, the impeller 1 may, when the pump is about to be started, be biased to the upper position. according to FIG. 2 by means of a spring. Not until the pump is started and the liquid starts to flow the impeller 1 will move towards the impeller seat 2. This will prevent the impeller 1 from shaking inside the pump housing during transportation. In addition, the starting torque for the impeller 1 is lowered since the impeller 1 and the impeller seat 2 are well distanced from each other.

If a large piece of solid matter enters the open channel 8 of the impeller seat 2, it is too large to get in-between the vane 5 of the impeller 1 and the top surface 9 of the impeller seat 2. But the groove 10 in conjunction with the vane 5 of the impeller 1 grabs hold of the solid matter and forces it to "climber" over the top surface 9 of the impeller seat 2 along the groove 10.

Finally, it shall be pointed out that the most preferred number of grooves 10 is one. Furthermore, the pump shall preferably comprise one guide pin 11. Otherwise the open channel 8 should be too obstructed, which would adversely affect the function of the pump.

Feasible Modifications of the Invention

The invention is not limited only to the embodiments described above and shown in the drawings. Thus, the pump, or more precisely the impeller seat may be modified in all kinds of ways within the scope of the appended claims.

It shall be pointed out that instead of the impeller being movable along the drive shaft the axial movability may be achieved in a lot of ways, e.g. both the drive shaft and the impeller may be movable away from the impeller seat, or the impeller seat may be movable away from the impeller, or both the impeller and the impeller seat may be movable away from each other. In addition, only the vanes may be movable in the axial direction in relation to the hub of the impeller. For example, each vane is individually movable and runs in a groove on the outside of the hub, thereby at lease one part of the vane is movable in the axial direction in relation to the impeller seat.

The invention claimed is:

1. A pump for pumping contaminated liquid including large pieces of solid matter, comprising a pump housing provided with a rotatable impeller (1) suspended in a drive shaft (3) and having at least one vane (5), and an impeller seat (2) having a top surface (9), the rotatable impeller (1) and the impeller seat (2) being axially separated from each other a distance of at least 0.1 mm when the impeller (1) is seated adjacent the impeller seat (2), at least one part of the impeller (1) and the impeller seat (2), during operation of the pump, being movable in the axial direction in relation to each other, wherein the impeller seat (2) presents at least one groove (10) in the top surface (9) thereof, and wherein the groove (10) extends from a centrally located open channel (8) in the impeller seat (2) towards the periphery thereof.

2. A pump according to claim 1, wherein the impeller (1) is movable at least 15 mm from the impeller seat (2).

3. A pump according to claim 1, wherein the impeller (1) is movable at least 40 mm from the impeller seat (2).

4. A pump according to claim 1, wherein the groove (10) extends in a spiral shape, from the open channel (8) and outwards along the direction of rotation of the impeller (1).

5. A pump according to claim 4, wherein the vane (5) of the impeller (1) extends in a spiral shape in the opposite direction to the spiral shape of the groove (10).

6. A pump according to claim 1, wherein the impeller (1) is freely movable in the axial direction in relation to the drive shaft (3).

7. A pump according to claim 1, wherein the pump comprises at least one discrete element (18) arranged at an interface between the impeller (1) and the drive shaft (3).

8. A pump for pumping contaminated liquid including large pieces of solid matter, comprising a pump housing provided with a rotatable impeller (1) suspended in a drive shaft (3) and having at least one vane (5), and an impeller seat (2) having a top surface (9), at least one part of the impeller (1) and the impeller seat (2), during operation of the pump, being movable in the axial direction in relation to each other, wherein the impeller seat (2) presents at least one groove (10) in the top surface (9) thereof;

wherein the pump comprises at least one discrete element (18) arranged at an interface between the impeller (1) and the drive shaft (3);

wherein the impeller (1) and the drive shaft (3) presents recesses (19, 20) in the opposite surfaces at said interface, which recesses (19, 20) jointly accommodate said element (18).

9. A pump according to claim 8, wherein the interface accommodate at least two discrete elements (18), which are equidistant separated from each other along the circumference of the drive shaft.

10. A pump according to 7, wherein each element (18) comprises a bar extending in the longitudinal direction of the drive shaft (3).

11. A pump according to claim 1, wherein a guide pin (11) extends from the impeller seat (9) towards the center of the impeller (1) and is located adjacent to said groove (10).

12. A pump according to claim 2, wherein the groove (10) extends from a centrally located open channel (8) in the impeller seat (2) to the periphery thereof.

13. A pump according to claim 12, wherein the groove (10) extends in a spiral shape, from the open channel (8) and outwards along the direction of rotation of the impeller (1).

14. A pump according to claim 13, wherein the vane (5) of the impeller (1) extends in a spiral shape in the opposite direction to the spiral shape of the groove (10).

15. A pump for pumping contaminated liquid including large pieces of solid matter, comprising a pump housing provided with a rotatable impeller (1) suspended in a drive shaft (3) and having at least one vane (5), and an impeller seat (2) having a top surface (9) and a periphery, the rotatable impeller (1) and the impeller seat (2) being axially separated from each other a distance of at least 0.1 mm when the impeller (1) is seated adjacent the impeller seat (2), at least one part of the impeller (1) and the impeller seat (2), during operation of the pump, being movable in the axial direction in relation to each other, wherein the impeller seat (2) presents at least one groove (10) in the top surface (9) thereof; and wherein the groove (10) extends in a spiral shape from a centrally located open channel (8) in the impeller seat (2) outwards to the periphery of the impeller seat (2) along a direction of rotation of the impeller (1).

* * * * *